US008328040B2

(12) United States Patent
Ries

(10) Patent No.: US 8,328,040 B2
(45) Date of Patent: Dec. 11, 2012

(54) MULTIPLE-WALLED STORAGE TANK

(75) Inventor: Jason Wayne Ries, Winamac, IN (US)

(73) Assignee: Sabre Mfg., LLC, Knox, IN (US)

( * ) Notice: Subject to any disclaimer, the term of this patent is extended or adjusted under 35 U.S.C. 154(b) by 210 days.

(21) Appl. No.: 12/699,997

(22) Filed: Feb. 4, 2010

(65) Prior Publication Data

US 2011/0186581 A1 Aug. 4, 2011

(51) Int. Cl.
*B60D 3/00* (2006.01)
*B62D 33/00* (2006.01)
*B65D 88/12* (2006.01)

(52) U.S. Cl. ..... 220/562; 220/DIG. 24; 280/837; 280/839

(58) Field of Classification Search ..... 220/592.2, 220/592.26, 564, 562, 560.03, 254.1, DIG. 24, 220/562.03; 280/830–839
See application file for complete search history.

(56) References Cited

U.S. PATENT DOCUMENTS

| | | | | | |
|---|---|---|---|---|---|
| 1,669,022 | A * | 5/1928 | Root, Jr. | ..... | 220/562 |
| RE19,537 | E * | 4/1935 | Pierce | ..... | 220/562 |
| 5,653,469 | A * | 8/1997 | Wade | ..... | 220/562 |
| 6,039,123 | A * | 3/2000 | Webb | ..... | 220/565 |
| 6,375,222 | B1 * | 4/2002 | Wade | ..... | 220/562 |

* cited by examiner

*Primary Examiner* — Mickey Yu
*Assistant Examiner* — Chun Cheung
(74) *Attorney, Agent, or Firm* — Hartman Global IP Law; Gary M. Hartman; Domenica N. S. Hartman

(57) ABSTRACT

A liquid storage tank includes a vessel comprising sidewalls, end walls, a floor and a roof that define a closed interior cavity within the vessel, with at least a first of the sidewalls of the vessel having a multi-walled construction comprising an interior wall and an interior wall. The tank further comprises a manway assembly in the first sidewall. The manway assembly comprises exterior and interior openings and exterior and interior doors for closing the exterior and interior openings, respectively. The exterior and interior openings and the exterior and interior doors are arranged relative to each other and the interior door is sufficiently small so that while the exterior door is open the interior door can be opened by pivoting the interior door into the exterior opening.

19 Claims, 6 Drawing Sheets

MULTIPLE-WALLED STORAGE TANK

BACKGROUND OF THE INVENTION

The present invention generally relates to tanks for liquid storage. More particularly, this invention relates to a multiple-walled liquid storage tank equipped with one or more manways located in a wall of the tank.

Various types of liquid storage tanks are employed in industry. A frac tank is a particular example of storage tank developed for the drilling and oil field industries and used in various other fields where containment of a material is important for safety and environmental reasons. Frac tanks typically have liquid capacities in excess of 10,000 gallons (about 40,000 liters), and may be equipped with wheels to facilitate the transport of the tank between job sites. Their large capacities, mobility, and rugged designs make frac tanks well suited for storing a variety of liquids. The sidewalls, end walls, and floors of frac tanks used to store particularly hazardous liquids often have a double-walled construction with interior and exterior walls separated by a closed interstitial cavity. With this construction, failure of the interior wall does not result in leakage outside the tank, but instead results in the accumulation of liquid within the interstitial cavity. The integrity of the interior wall can be monitored by inspecting the interstitial cavity for the presence of liquid.

Inevitably, the interior of a storage tank requires cleaning, often with the result that a worker must enter the interior of the tank through a manway. Conventional constructions of frac tanks and other large storage tanks typically locate manways in the roof of the tank, where a single-walled construction is permitted for most applications. In addition to reducing the risk of leakage through its cover, the location of a manway in the roof of the tank also avoids the complication of providing a fluid-tight manway in a storage tank whose sidewalls have a double-walled construction.

BRIEF DESCRIPTION OF THE INVENTION

The present invention provides a liquid storage tank equipped with sidewalls having a multiple-walled construction and a personal access in at least one of the sidewalls.

According to an aspect of the invention, the liquid storage tank includes a vessel comprising sidewalls, end walls, a floor and a roof that define a closed interior cavity within the vessel, with at least a first of the sidewalls of the vessel having a multi-walled construction comprising an exterior wall and an interior wall. The tank further comprises a manway assembly in the first sidewall. The manway assembly comprises exterior and interior openings and exterior and interior doors for closing the exterior and interior openings, respectively. The exterior and interior openings and the exterior and interior doors are arranged relative to each other and the interior door is sufficiently small so that while the exterior door is open the interior door can be opened by pivoting the interior door into the exterior opening.

Various aspects and advantages of this invention will be better appreciated from the following detailed description.

DETAILED DESCRIPTION OF THE INVENTION

FIGS. 1 through 11 depict a liquid storage tank 10 and its various components in accordance with a preferred embodiment of the invention. The tank 10, which can be configured as a frac tank, can be sized to have a variety of capacities, with preferred capacities being in excess of 10,000 gallons (about 40,000 liters) and more preferably in excess of 15,000 gallons (about 60,000 liters), though lesser capacities are also within the scope of the invention. It should be noted that the drawings are drawn for purposes of clarity when viewed in combination with the following description, and therefore are not necessarily to scale. To facilitate the description of the tank 10, the terms "vertical," "horizontal," "front," "rear," "side," "upper," "lower," "above," "below," "right" and "left" may used in reference to the perspective of an operator when transporting the tank 10, and therefore are relative terms and should not be interpreted as otherwise limiting the scope of the invention.

Figure 1:
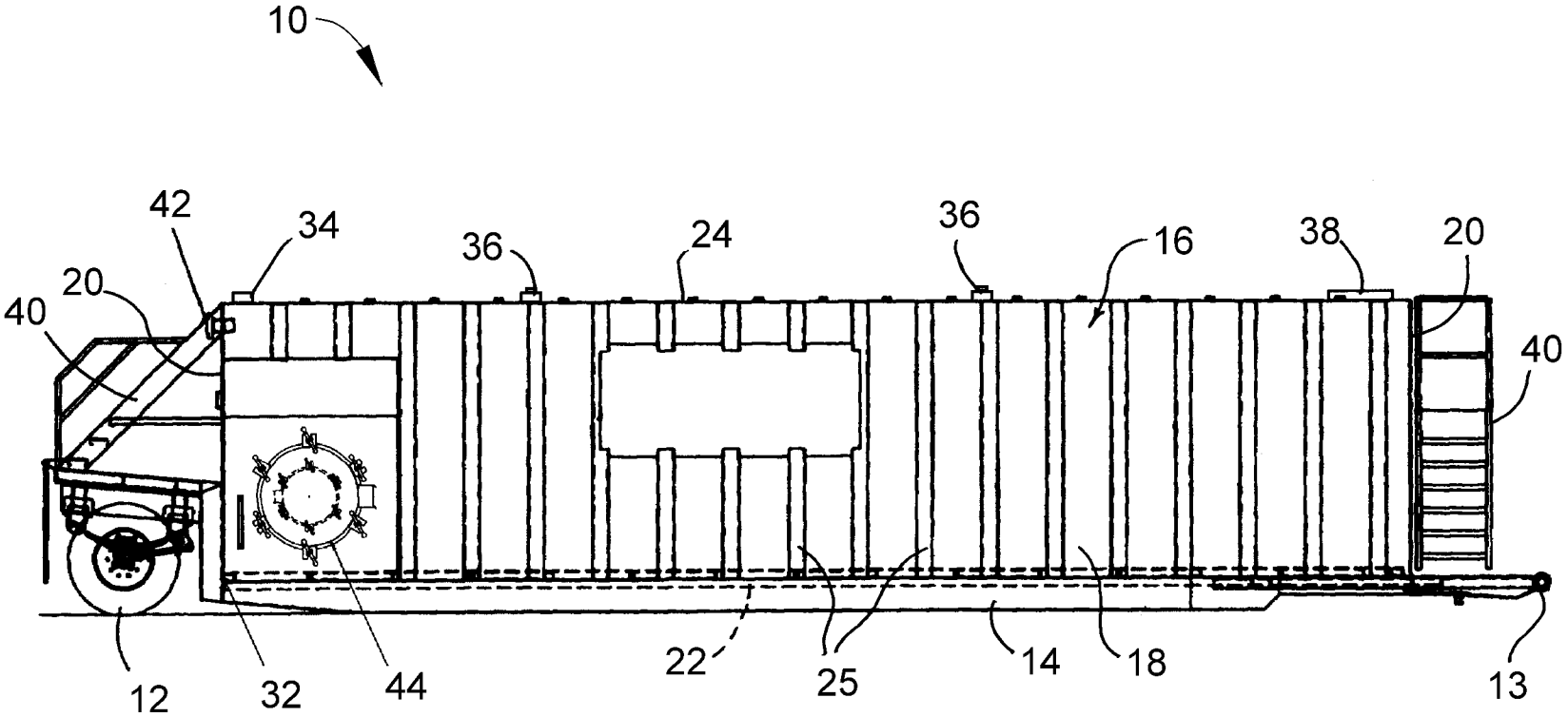
FIG. 1 is a side view of a liquid storage tank equipped with at least one sidewall manway in accordance with a preferred embodiment of this invention.

FIG. 1 is a side view of the tank 10 and shows the tank 10 equipped with wheels 12 (one of which is visible) and a hitch 13 for transporting (towing) the tank 10 between job sites. The tank 10 has a lower frame 14 that supports a containment vessel 16 of the tank 10, as well as provides a framework for supporting the wheels 12 and their suspension components. The vessel 16 is constructed to be enclosed on all sides with a pair of sidewalls 18, a pair of end walls 20, a floor 22, and a roof 24, which define a closed interior cavity within the vessel 16. The vessel 16 is preferably capable of safely storing a variety of liquids, including liquids that are hazardous to the environment. For this reason, the sidewalls 18, end walls 20, and floor 22 of the vessel 16 are shown in FIG. 3 as having a double-walled construction with interior and exterior walls 26 and 28 separated by a closed interstitial cavity 30. With this construction, a failure (for example, by damage, corrosion, structural failure, etc.) of any of the interior walls 26 does not result in leakage outside the vessel 16, but instead results in the accumulation of liquid within the interstitial cavity 30. The integrity of the interior walls 26 can be monitored by inspecting the cavity 30 for the presence of liquid, such as with one or more drains 32, one of which is represented in the rear end wall 20 in FIGS. 1 through 3.

In contrast to the sidewalls 18, end walls 20 and floor 22, the roof 24 of the vessel 16 is shown in FIG. 3 as having a single-wall construction. Because use of the tank 10 can entail storage of very large volumes of liquids, resulting in very high static fluid pressures, the strength of the sidewalls 18 and roof 24 can be promoted by reinforcing their walls, such as forming the walls to have ribs 25 as represented in FIGS. 1 to 3, though a corrugated cross-section or other type of reinforcement could also be used.

FIG. 1 represents a pressure relief valve 34, auxiliary ports 36, and an upper manway 38 as being conventionally located in the roof 24. Stairways 40 are located at each end of the tank 10 to permit access to the roof 24 and its ports 36 and manway 38. An additional auxiliary port 42 is shown located in the rear end wall 20. The ports 36 and 42 provide inlets through which a liquid (or another material) can be introduced into the vessel 16. Drains (now shown) are also provided through which the contents of the vessel 16 can be drained. The floor 22 can be seen in FIG. 3 to slope toward the longitudinal centerline of the tank 10 to promote drainage of the vessel 16.

Though the interior of the tank 10 can be accessed for cleaning through the upper manway 38 on the roof 24 of the tank 10, the present invention provides at least one additional manway 44 in at least one of the sidewalls 18 of the vessel 16. In contrast to the upper manway 38 located in the roof 24 of the vessel 16, where the single-walled construction of the roof 24 provides for an uncomplicated installation for the manway 38, installation of the sidewall manway 44 is complicated by the double-walled construction of the sidewall 18. For this reason, the present invention provides a manway housing assembly 46 that includes the manway 44 as well as structure adapted to incorporate the manway 44 into the double-walled construction of the sidewall 18 in a manner that reduces the risk of leakage while allowing access to the interior of the vessel 16 through the manway 44.

Figure 2:
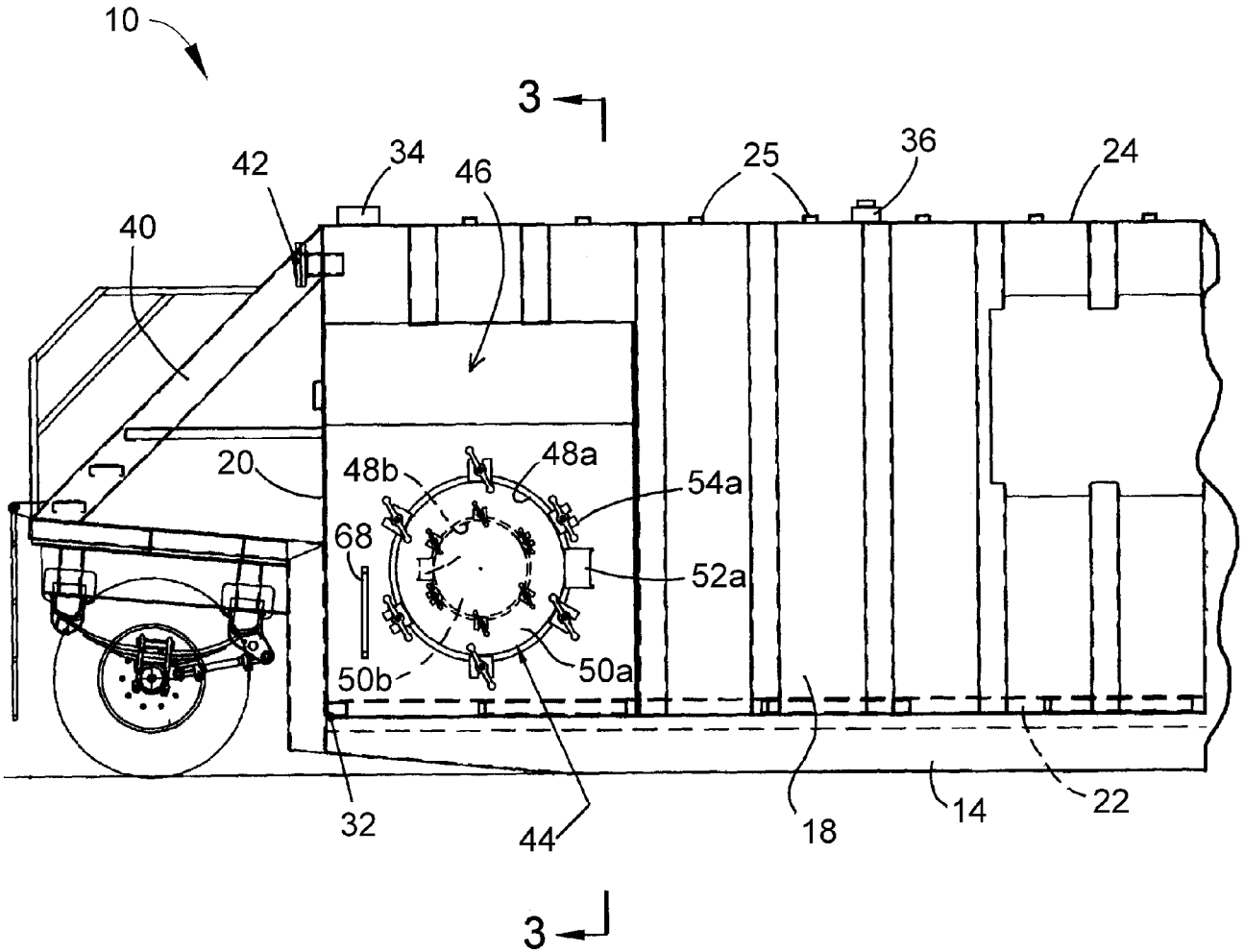
FIG. 2 is a detailed view of the rear end and the sidewall manway of the storage tank of FIG. 1.
Figure 3:
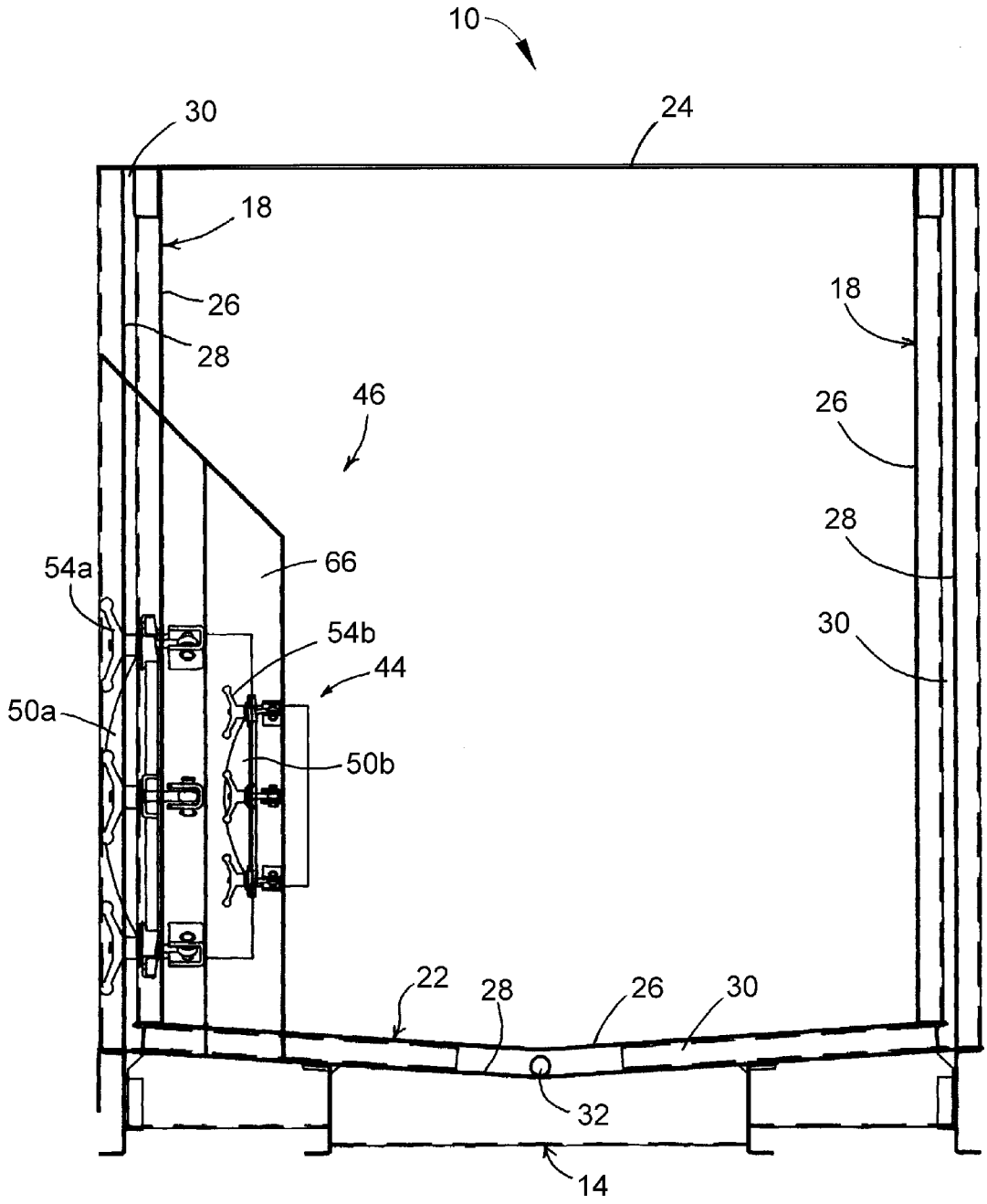
FIG. 3 is a cross-sectional view along section line 3-3 of FIG. 2.

As more readily apparent from FIGS. 2 and 3, the manway 44 comprises two axially-aligned openings 48*a* and 48*b* closed by two separate covers or doors 50*a* and 50*b*. Because of this construction, the manway 44 will be referred to as a dual manway 44 to distinguish it from conventional manways (such as the roof manway 38) that have a single opening and door. The opening 48*b* and its door 50*b* are located interior of the opening 48*a* and its door 50*a*, corresponding to the interior and exterior walls 26 and 28 of the double-walled construction of the sidewall 18. As evident from FIG. 2, the doors 50*a* and 50*b* are equipped with hinges 52*a* and 52*b*, respectively, that are oppositely disposed so that the doors 50*a* and 50*b* are opened by being pivoted in opposite directions. Each door 50*a* and 50*b* is equipped with closure assemblies 54*a* or 54*b* by which the doors 50*a* and 50*b* can be closed to provide a fluid-tight seal. The interior opening 48*b* is smaller in diameter than the exterior opening 48*a*, which in combination with the opposing locations of their hinges 52*a* and 52*b* enables both doors 50*a* and 50*b* to be open at the same time to freely permit access to the interior of the vessel 16 through the dual manway 44. As nonlimiting examples, suitable diameters for the openings 48*a* and 48*b* are 36 and 20 inches (about 90 and 50 cm), respectively. Larger and smaller openings 48*a* and 48*b* are also within the scope of this invention, with the limitation that the interior opening 48*b* must be sufficiently smaller than the exterior opening 48*a* to permit its door 50*b* to swing open through the exterior opening 48*a*. In other words, the interior door 50*b* must be able to fit within the exterior opening 48*a*. To facilitate this, the exterior and interior openings 48*a* and 48*b* are preferably coaxially aligned, though this alignment would not be necessary if the exterior opening 48*a* and the interior door 50*b* sufficiently differ in size.

Figure 5:
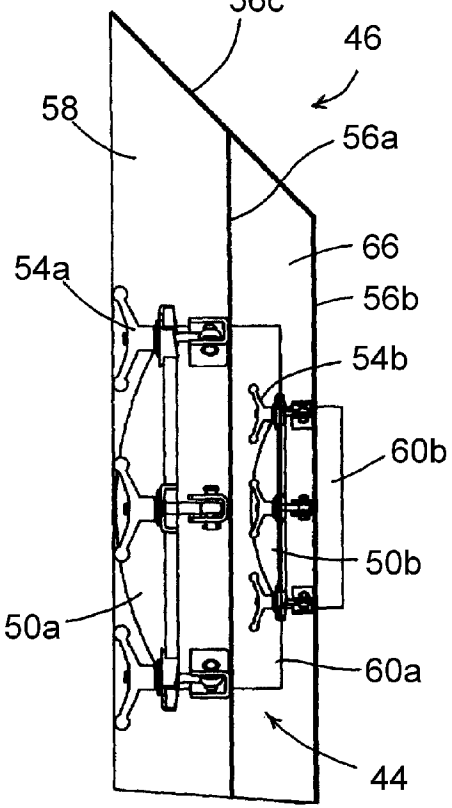
FIGS. 4 and 5 are isolated views of a housing assembly containing the sidewall manway of FIGS. 1 through 3.
Figure 4:
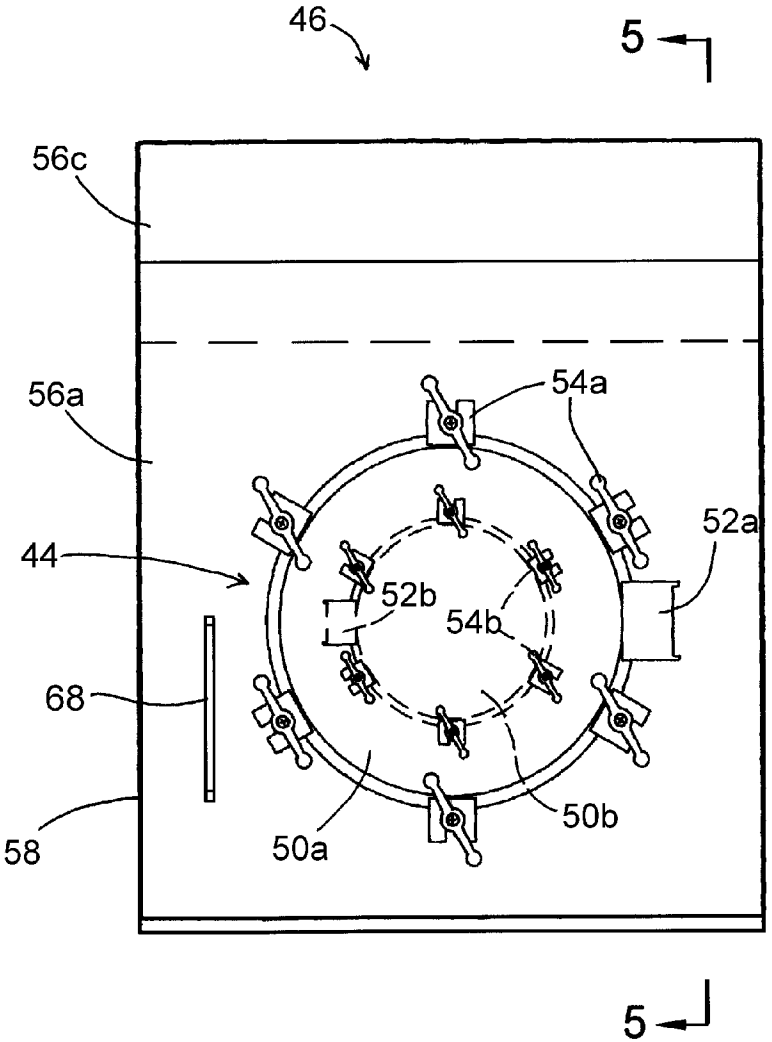
Figure 8:
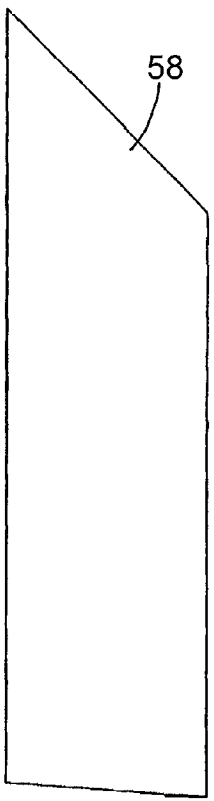
FIG. 8 is an isolated view of one of two lateral walls of the housing assembly of FIGS. 4 and 5.
Figure 7:
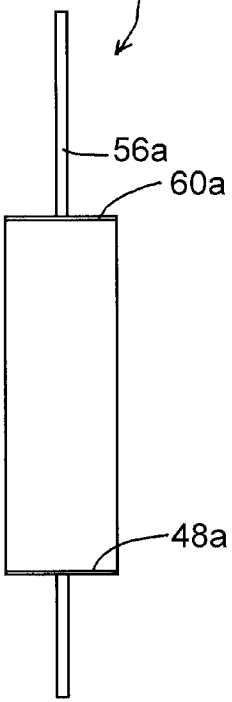
FIGS. 6 and 7 are isolated front and side views, respectively, of an exterior wall assembly of the housing assembly of FIGS. 4 and 5.
Figure 6:
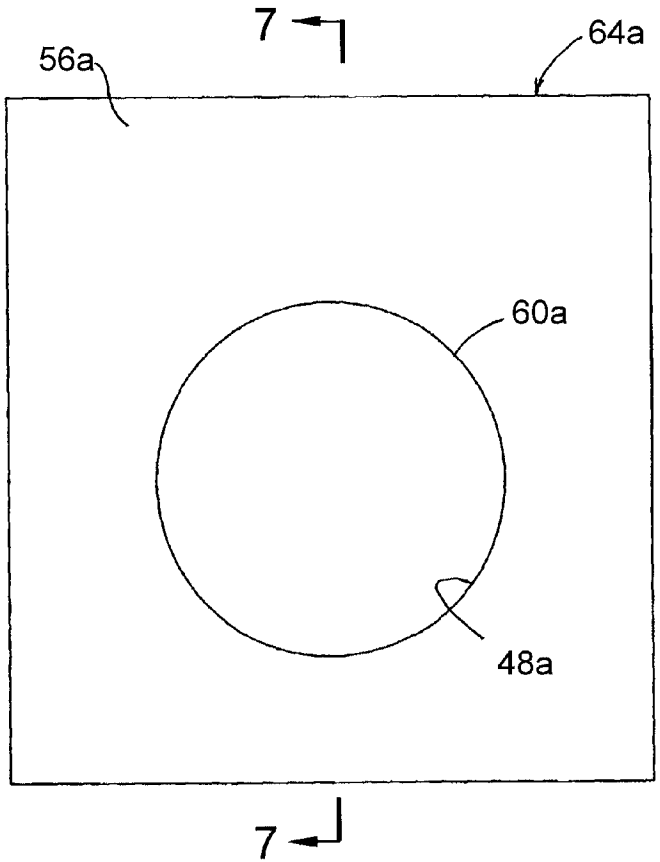
Figure 10:
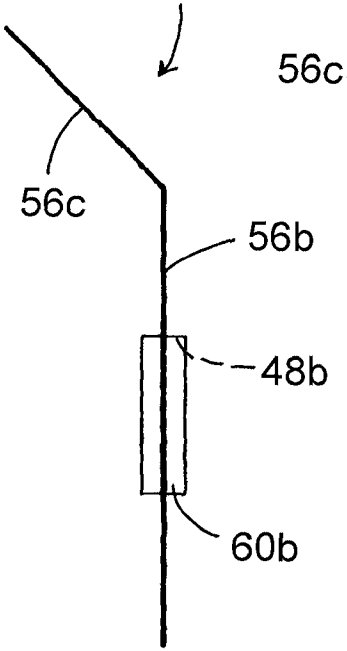

FIGS. 4 and 5 are isolated views of the manway housing assembly 46 containing the dual manway 44 of FIGS. 1 through 3. FIGS. 6 and 7 are isolated front and side views, respectively, of an exterior wall assembly 64*a* of the housing assembly 46, FIG. 8 is an isolated view of one of two lateral walls 58 of the housing assembly 46, FIG. 9 is an isolated view of the interior door 50*b* mounted to an interior wall assembly 64*b* of the housing assembly 46, and FIGS. 10 and 11 show side and front views, respectively, of the interior wall assembly 64*b* of FIG. 9 without the door 50*b*.

As evident from FIGS. 6 and 7, the exterior wall assembly 64*a* is formed by a flat wall 56*a* in which the opening 48*a* is formed, preferably by placing a cylindrical insert 60*a* in a circular hole in the wall 56*a*. Similarly, FIGS. 10 and 11 show the interior wall assembly 64*b* as formed by a flat wall 56*b* in which the opening 48*b* is formed by placing an cylindrical insert 60*b* in a circular hole in the wall 56*b*. The interior wall assembly 64*b* includes an upper sloping wall 56*c* that can be formed by bending the upper region of the wall 56*b* or formed separately and then welded to the wall 56*b* to define a sloping ceiling for the manway housing assembly 46. After fabricating the exterior and interior wall assemblies 64*a* and 64*b* and the lateral walls 58, the housing assembly 46 can be assembled by nesting the exterior wall assembly 64*a* within the interior wall assembly 64*b* so that the wall 56*a* of the exterior wall assembly 64*a* is spaced apart from the wall 56*b* of the interior wall assembly 64*b*, creating an interstitial cavity 66 within the manway housing assembly 46. The upper edge of the wall 56*a* of the exterior wall assembly 64*a* can then be welded or otherwise attached to the sloping upper wall 56*c* of the interior wall assembly 64*b*, and the lateral walls 58 welded or otherwise attached to the lateral edges of the walls 56*a*, 56*b* and 56*c*. The doors 50*a* and 50*b* and their hinges 52*a* and 52*b* and closure assemblies 54*a* and 54*b* can then be assembled to their respective wall assemblies 64*a* and 64*b*.

Figure 11:
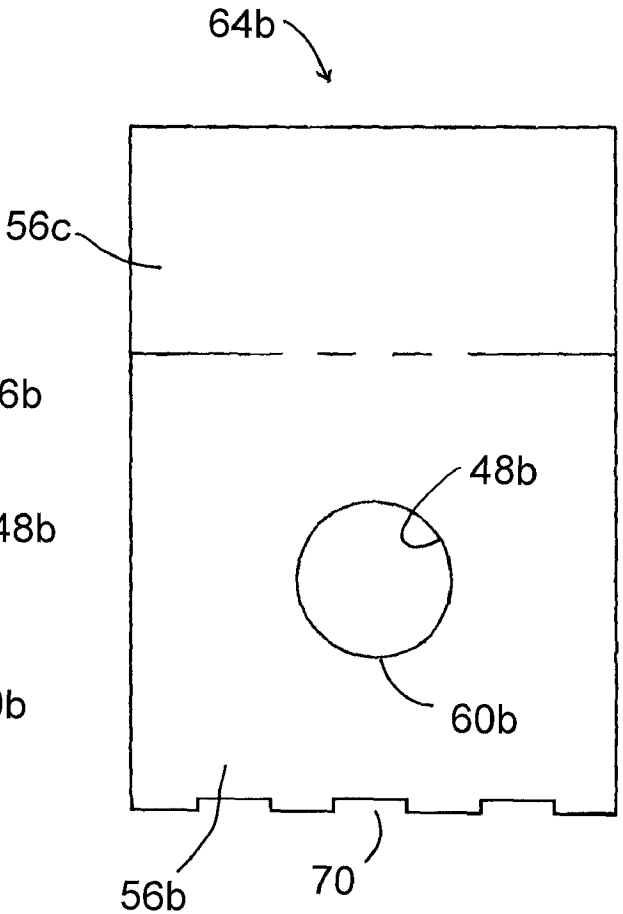
FIGS. 10 and 11 show side and front views, respectively, of the interior wall assembly of FIG. 9.
Figure 9:
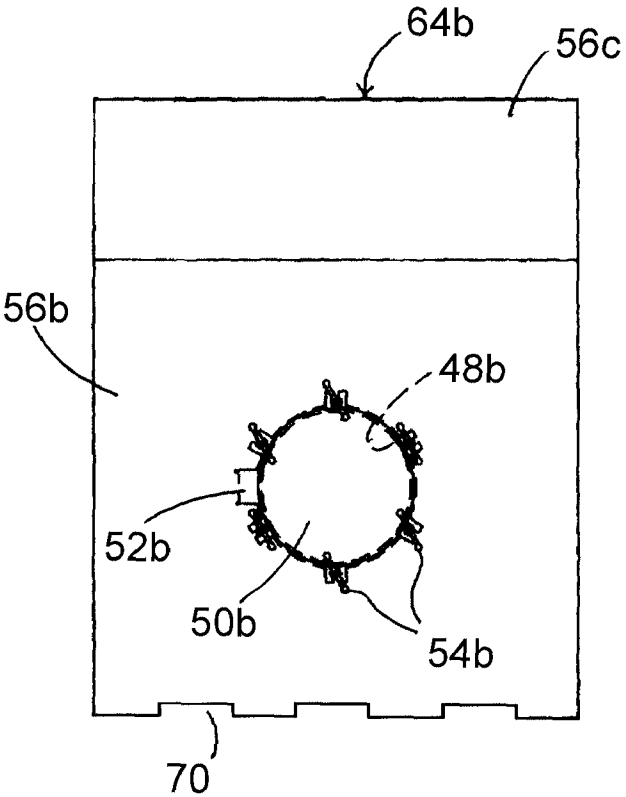
FIG. 9 is an isolated view of an interior door mounted to an interior wall assembly of the housing assembly of FIGS. 4 and 5.

Slots 70 shown in FIGS. 9 and 11 as defined at the lower edge of the wall 56*b* can be used to drain the interstitial cavity 66 between the walls 56*a* and 56*b* to the interstitial cavity 30 in the floor 20 to reduce the likelihood that the level of any leakage will rise as high as the outer door 50*a*. The integrity of the walls 56*a*, 56*b*, 56*c* and 58 can be monitored with a sight gauge 68 shown in FIGS. 1, 2 and 4 as mounted to the wall 56*a* of the manway housing assembly 46 and fluidically connected to the interstitial cavity 66.

The resulting manway housing assembly 46 can then be installed on the tank frame 14, along with the sidewalls 18, end walls 20, floor 22 and roof 24. As evident from FIGS. 2 and 3, the double-walled sidewall 18 in which the dual manway 44 is installed is attached to the perimeter of the housing assembly 46, such that the housing assembly 46 defines a recess in the sidewall 18.

Suitable materials and sizes and suitable fabrication and assembly methods for the individual components of the dual manway 44 and manway housing assembly 46, as well as for the tank 10 as a whole, are well within the scope of one skilled in the art and therefore will not be discussed in any detail here.

In use, access to the interior of the tank 10 can be gained by first opening the exterior door 50*a* to expose the opening 48*a* in the exterior wall assembly 64*a* as well as expose the interior door 50*b* of the interior wall assembly 64*b*, and then opening the interior door 50*b* by swinging it outward through the opening 48*a* of the exterior wall assembly 64*a*. Opening the interior door 50*b* exposes the opening 48*b* in the interior wall assembly 64*b* through which direct access can be made to the interior of the tank 10.

While the invention has been described in terms of a preferred embodiment, it is apparent that other forms could be adopted by one skilled in the art. For example, the physical configuration of the tank 10, the vessel 16, the dual manway 44, and the manway housing assembly 46 could differ from that shown. As an example, the openings 48*a* and 48*b*, doors 50*a* and 50*b*, and inserts 60*a* and 60*b* could be other than circular. In addition, though a double-walled construction is shown for the sidewalls 18 and end walls 20 of the tank 10, the invention can be adapted for use with any multi-walled construction by fabricating the housing assembly 46 to include additional wall assemblies, for example, one or more intermediate wall assemblies between the exterior and interior wall assemblies 64*a* and 64*b*. Therefore, the scope of the invention is to be limited only by the following claims.

The invention claimed is:

1. A liquid storage tank comprising:

a vessel comprising sidewalls, end walls, a floor and a roof that define a closed interior cavity within the vessel, at least a first of the sidewalls of the vessel having a multi-walled construction comprising an interior vessel wall and an exterior vessel wall, the interior vessel wall defining a portion of the closed interior cavity of the tank; and a manway assembly in the first sidewall, the manway assembly comprising exterior and interior manway walls coupled to the interior and exterior vessel walls, respectively, an interstitial manway cavity between the exterior and interior manway walls, exterior and interior manway openings in the exterior and interior manway walls, respectively, and exterior and interior doors for closing the exterior and interior manway openings, respectively, to provide fluid-tight seals between, respectively, the interstitial manway cavity and an exterior of the vessel and between the interior cavity and the interstitial manway cavity, the interior manway opening being disposed in the first sidewall such that the interior door prevents a liquid within the interior cavity from leaking into the interstitial manway cavity through the interior manway opening, the exterior manway opening being disposed in the first sidewall such that the exterior door prevents a liquid within the interstitial manway cavity from leaking to the exterior of the vessel through the exterior manway opening, the manway assembly further comprising means for draining a liquid from the interstitial manway cavity to a second interstitial cavity within the floor of the vessel.

2. The liquid storage tank according to claim 1, further comprising a manway housing assembly containing the manway assembly.

3. The liquid storage tank according to claim 2, wherein the manway housing assembly comprises:

an exterior wall assembly comprising the exterior manway wall in which the exterior manway opening is defined and to which the exterior door is mounted; and an interior wall assembly comprising the interior manway wall in which the interior manway opening is defined and to which the interior door is mounted.

4. The liquid storage tank according to claim 3, wherein the exterior wall assembly comprises a first insert that is mounted in the exterior manway wall and defines the exterior manway opening.

5. The liquid storage tank according to claim 4, wherein the interior wall assembly comprises a second insert that is mounted in the interior manway wall and defines the interior manway opening, and the interior manway wall of the interior wall assembly is spaced apart from the exterior manway wall of the exterior wall assembly.

6. The liquid storage tank according to claim 5, wherein the interstitial manway cavity is within the manway housing assembly.

7. The liquid storage tank according to claim 6, further comprising means outside the interstitial manway cavity for visually detecting the presence of a liquid within the interstitial manway cavity.

8. The liquid storage tank according to claim 1, wherein the draining means comprises at least one opening in the interior manway wall.

9. The liquid storage tank according to claim 8, wherein the at least one opening comprises slots formed at a lowermost extent of the interior manway wall.

10. The liquid storage tank according to claim 2, wherein the manway housing assembly defines a recess in the first sidewall.

11. The liquid storage tank according to claim 10, wherein the interior wall assembly comprises a third wall that defines a ceiling of the recess.

12. The liquid storage tank according to claim 1, wherein the exterior and interior manway openings are co-axially aligned and the exterior and interior doors are arranged relative to each other and the interior door is sufficiently small so that while the exterior door is open the interior door can be opened by pivoting the interior door into the exterior manway opening.

13. The liquid storage tank according to claim 1, wherein the first sidewall of the vessel has a double-walled construction formed by the interior and exterior vessel walls.

14. The liquid storage tank according to claim 1, wherein the interior and exterior vessel walls define a second interstitial cavity therebetween adapted to receive and contain a liquid that leaks through the interior vessel wall.

15. The liquid storage tank according to claim 14, further comprising means for draining the second interstitial cavity.

16. The liquid storage tank according to claim 1, further comprising means for transporting the liquid storage tank.

17. The liquid storage tank according to claim 16, wherein the transporting means comprises wheels and a hitch.

18. The liquid storage tank according to claim 1, further comprising a manway located in the roof of the liquid storage tank.

19. The liquid storage tank according to claim 1, wherein the closed interior cavity of the vessel has a capacity of at least 10,000 gallons.

* * * * *